US005823534A

United States Patent [19]

Banyai

[11] Patent Number: 5,823,534

[45] Date of Patent: Oct. 20, 1998

[54] TABLE BINGO GAME METHOD

[75] Inventor: Frank B. Banyai, Temecula, Calif.

[73] Assignee: Jester Games International, L.L.C., Las Vegas, Nev.

[21] Appl. No.: 644,238

[22] Filed: May 10, 1996

Related U.S. Application Data

[63] Continuation-in-part of Ser. No. 558,828, Nov. 16, 1995, abandoned.

[51] Int. Cl.[6] ..... A63F 1/00

[52] U.S. Cl. ..... 273/269; 273/274

[58] Field of Search ..... 273/269, 274

[56] References Cited

U.S. PATENT DOCUMENTS

| | | | |
|---|---|---|---|
| 4,254,404 | 3/1981 | White . | |
| 4,364,567 | 12/1982 | Goott . | |
| 4,441,714 | 4/1984 | Goott . | |
| 4,577,869 | 3/1986 | Brinkman . | |
| 4,635,938 | 1/1987 | Gray . | |
| 4,756,531 | 7/1988 | Dire et al. . | |
| 4,856,787 | 8/1989 | Itkis . | |
| 5,005,840 | 4/1991 | Schwartz . | |
| 5,022,653 | 6/1991 | Suttle et al. . | |
| 5,088,737 | 2/1992 | Frank et al. . | |
| 5,265,877 | 11/1993 | Boylan et al. . | |
| 5,269,523 | 12/1993 | Boylan et al. . | |
| 5,275,415 | 1/1994 | Wisted . | |
| 5,326,104 | 7/1994 | Pease et al. . | |
| 5,360,214 | 11/1994 | Harmen . | |
| 5,380,007 | 1/1995 | Travis et al. . | |
| 5,401,024 | 3/1995 | Simunek . | |
| 5,494,293 | 2/1996 | Goldfarb | 273/269 |
| 5,536,016 | 7/1996 | Thompson | 273/274 |

OTHER PUBLICATIONS

"Race Horse Keno", Scarne's Complete Guide to Gambling, By John Searne, Simon and Shuster 1961, pp. 432–436.

"Wisted's California Blackjack", Commerce Casino, Commerce, CA, 1992 (Brochure).

*Primary Examiner*—William M. Pierce

*Attorney, Agent, or Firm*—David Weiss

[57] ABSTRACT

A bingo game for being played by a plurality of players employing a table having respective player stations thereabout. The game permits each player to select each of his or her numbers to be matched during play by randomly drawn numbers, including a wild designation which each player may deem to match one of his or her selected numbers, and the game is permitted to progress at multiple levels of play notwithstanding the occurrence of prior bingos in the game being played.

32 Claims, 2 Drawing Sheets

Fig. 2.
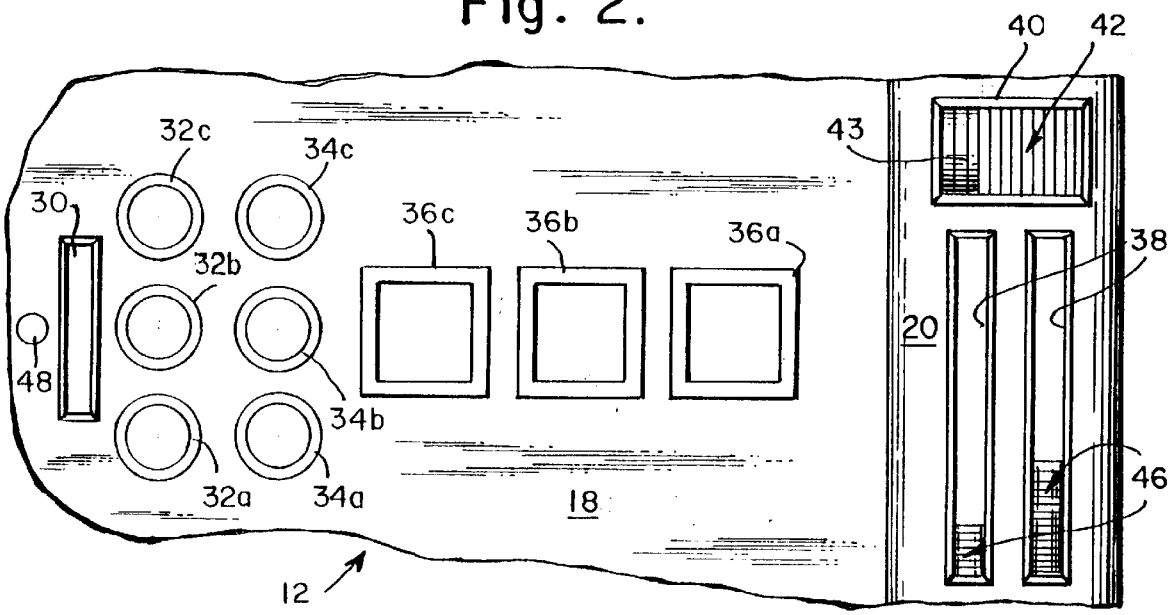
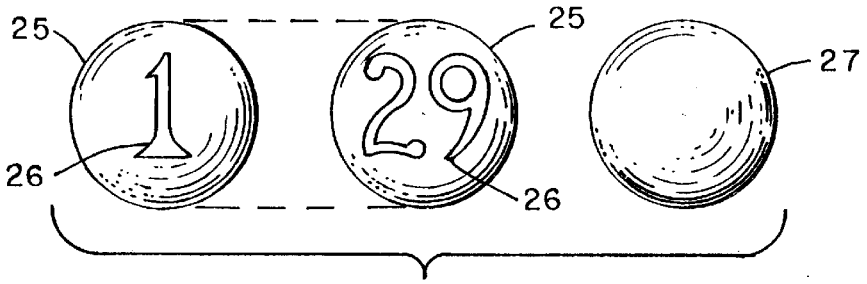
Fig. 6.
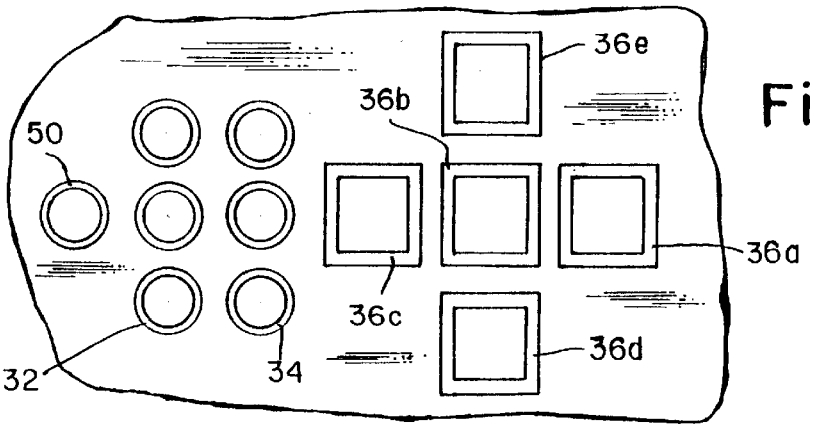
Fig. 7.

TABLE BINGO GAME METHOD

CROSS-REFERENCE TO RELATED APPLICATION

This application is a continuation-in-part of U.S. patent application Ser. No. 08/558,828, filed Nov. 16, 1995, now abandoned.

BACKGROUND OF THE INVENTION

This invention relates to bingo games, and more particularly to a bingo game for being played at a game table as well as the game table therefor.

The gaming industry has expanded dramatically over the past ten years, both nationally and internationally. Electronic and video gaming has taken the lead in regard to revenue production, capturing up to seventy percent in some markets. Partially responsible for this trend is the creativity and imagination that electronic devices command, together with the speed by which such games are played.

The game of bingo traditionally is played by a plurality of players, each of whom holds a card bearing numbers arranged in a 5×5 space matrix and covers such numbers when matched by similar numbers randomly drawn. The game is won, i.e. a "bingo" occurs, by the first person covering a line of five spaces on the card.

Traditional bingo and other games similar to bingo, which satisfy particular legal requirements, may be played for charitable purposes as well as in Indian gaming establishments or casinos. High stakes bingo, evolved in Indian reservations where many other gaming activities may not be practiced, has received considerable attention in recent years. Although high stakes bingo has grown in popularity on Indian lands, it typically requires high space demands and a relatively large number of players to be economically feasible. Further, bingo has generally remained quite basic, lacking not only the excitement of electronic gaming but also the intimacy and fast action of traditional table games such as blackjack, poker, roulette and craps.

Variations in the game of bingo have been offered in the past, in attempts to increase the speed of play while striving to comply with the basic legal requirements for permissible bingo games. Some of these variations have attempted to adapt bingo to table play, with hopes of capturing the intimacy and fast action of traditional table games. One such form of bingo, generally known as "fast action" bingo and sometimes referred to as "lightning" or "bullet" bingo, while differing from traditional bingo by using a limited group of numbers (and in some cases three numbers), are nevertheless labor intensive and require large numbers of players to be financially successful, both for the players and for the bingo game operator. Moreover, the speed of play of such "fast action" games is still slow when compared with traditional table games.

Other attempts to adapt bingo to table play have been unsuccessful, primarily because they are either too complex for players to readily comprehend or do not meet the requirements for bingo under applicable gaming laws.

SUMMARY OF THE INVENTION

The present invention provides a bingo game which is simple and easy for an inexperienced player to readily comprehend, offering the speed or fast pace, intimacy, excitement and space saving qualities often found in traditional fast-paced table games, and which may be economically operated with a relatively few players. The game permits each player to select each of his or her numbers to be matched during play, and the game is permitted to progress at multiple levels of play notwithstanding the occurrence of prior bingos in the game being played.

The bingo game of the present invention, as disclosed in my co-pending application Ser. No. 08/588,828 and which disclosure is incorporated herein by reference, may be played by a plurality of players at playing stations positioned about a specially designed game table. According to one aspect of the present game, the playing of the game comprises the steps of: (a) providing each player with an arrangement of designations, preferably numbers; (b) each player buying into a first level of play with a first buy-in payment, and each player at his or her option may buy in into a second level of play with a second buy-in payment; (c) randomly selecting ones of the designations until all designations in one of the arrangements have been selected, whereupon the player holding the one arrangement is a winner and collects the first buy-in payments from all players, and further collects the second buy-in payments from all players who had bought into the second level of play provided the winner had bought into the second level of play; and (d) if the winner had not bought into the second level of play, continuing the game only with the players who had bought into the second level of play by resuming the random selection of designations until all designations in one of the arrangements held by the continuing players have been selected, whereupon the continuing player holding the latter-mentioned one arrangement is a winner and collects the second buy-in payments from all of the continuing players. During step (b), each player who had bought into the second level of play at his or her option may buy into a third level of play with a third buy-in payment; during step (c), the winner further collects the third buy-in payments from all players who had bought into the third level of play provided the winner had bought into the second and third levels of play; and during step (d), the winner of the second buy-in payments further collects the third buy-in payments from all of the continuing players who had bought into the third level of play provided the winner of the second buy-in payments had bought into the third level of play. If, however, the winner of the second buy-in payments had not bought into the third level of play, the game includes the step of (e) continuing the game only with the players remaining who had bought into the third level of play by resuming the random selection of designations until all designations in one of the arrangements held by the remaining players have been selected, whereupon the remaining player holding the last mentioned one arrangement is a winner and collects the third buy-in payments from all of the remaining players.

According to another aspect of the invention, the bingo game is played by a plurality of players employing a table having respective player stations thereabout, with each player selecting a plurality of designations from another plurality of designations and arranging his or her selected designations on the table at his or her station; each player buying into the game with a mandatory buy-in payment of a predetermined amount; and randomly drawing designations similar to the designations of the other plurality until all designations in one of the arrangements have been matched, whereupon the player holding that one arrangement is a winner and collects the mandatory buy-in payments from all of the players.

When buying into the game, each player at his or her option may buy into a jackpot with a jackpot buy-in payment, and the player whose selected designations are matched by each of the first designations successively drawn is a winner of the jackpot. In one manner of playing this aspect of the game, the player whose selected designations are matched in the order arranged by each of the first designations successively drawn is the jackpot winner.

In the preferred manner of playing the game of the present invention, by a plurality of players employing a table having respective player stations thereabout, the playing of the game comprises the steps of: (a) providing at each of the player stations a first plurality (preferably twenty-nine) of tiles respectively bearing different numbers (preferably 1 through 29 inclusive); (b) providing a random number generator for drawing numbers similar to the numbers on the first pluralities of tiles; (c) each player selecting a second plurality (preferable three) of tiles from the first plurality at his or her station and placing the tiles of the second plurality on the table; (d) each player buying into a first level of play by placing a first buy-in payment on the table, and each player at his or her option may buy into a second level of play by placing a second buy-in payment on the table; (e) using the random number generator to draw numbers until the numbers on one of the second pluralities of tiles selected by one of the players are matched by the drawn numbers, whereupon that one player collects all of the first buy-in payments on the table, and further collects all of the second buy-in payments on the table provided the winner had bought into the second level of play; and (f) if the winner had not bought into the second level of play, continuing the game only with the players who had bought into the second level of play by resuming the drawing of numbers until the numbers on one of the second pluralities of tiles selected by one of the continuing players are matched by the drawn numbers, whereupon such one continuing player is a winner and collects all of the second buy-in payments on the table.

During step (d), each player who had bought into the second level of play at his or her option may buy into a third level of play by placing a third buy-in payment on the table; during step (e), the winner therein further collects all of the third buy-in payments on the table provided such winner had bought into the second and third levels of play; and during step (f), the winner of the second buy-in payments further collects all of the third buy-in payments on the table provided such winner had bought into the third level of play. If, however, the winner of the second buy-in payments had not bought into the third level of play, the game is continued only with the players remaining who had bought into the third level of play by resuming the random drawing of numbers until all numbers on one of the second pluralities of tiles selected by one of the remaining players are matched by the drawn numbers, whereupon such one remaining player is a winner and collects all of the third buy-in payments on the table.

In a preferred aspect of the game, the random number generator includes an unnumbered or wild designation for being drawn, and when drawn may be deemed by each player to match one number on his or her plurality of selected tiles. The random number generator is preferably a ball blower including balls equal in quantity to the first plurality of tiles and respectively bearing the numbers on the tiles and further including an additional wild unnumbered ball which, when drawn, may be deemed by each player to match one number of his or her second plurality of selected tiles.

The game may be operated by a game operator; and each player, when placing the buy-in payments on the table, also places on the table a first fee along with his or her first buy-in payment, a second fee along with his or her second buy-in payment, and a third fee along with his or her third buy-in payment, all of these fees for collection by the game operator.

A preferred embodiment of the game table of the present invention comprises a table having a surface and a plurality of player stations spaced thereabout, each station including a first rack holding a first plurality of tiles bearing designations, a second rack for holding gaming chips, indicia on the table surface for permitting a player to arrange thereat a second plurality of tiles selected from the first plurality of tiles, indicia on the table surface for permitting a player to place thereat gaming chips for buying into a first level of game play and for paying a fee associated with the first level of play, indicia on the surface for permitting a player to place thereat gaming chips for buying into a second level game play and for paying a fee associated with the second level of play, indicia on the surface for permitting a player to place thereat gaming chips for buying into a third level of game play and for paying a fee associated with the third level of play. The game table further includes a random designation generator for drawing designations similar to the designations on the tiles of the first plurality of tiles, and preferably an additional wild designation which when drawn may be deemed by each player as similar to any one of the designations on his or her second plurality of tiles. The preferred game table further includes an operator station for accommodating two game operator clerks.

BRIEF DESCRIPTION OF THE DRAWINGS

The novel features which are believed to be characteristic of the invention, together with further advantages thereof, will be better understood from the following description considered in connection with the accompanying drawings in which a preferred embodiment of the invention and its utilization are illustrated by way of example. It is to be expressly understood, however, that the drawings are for the purpose of illustration and description only and are not intended as a definition of the limits of the invention.

FIG. 2 is a top view of a preferred configuration of a player station of the table of FIG. 1 indicated therein by the dashed enclosure 2, shown enlarged for clarity of description;

FIG. 6 is an elevation view of balls for use with a ball blower in playing the preferred game embodiment; and FIG. 7 is an alternative configuration of a portion of a player station of the table of FIG. 1.

DESCRIPTION OF THE PREFERRED EMBODIMENT

Figure 1:
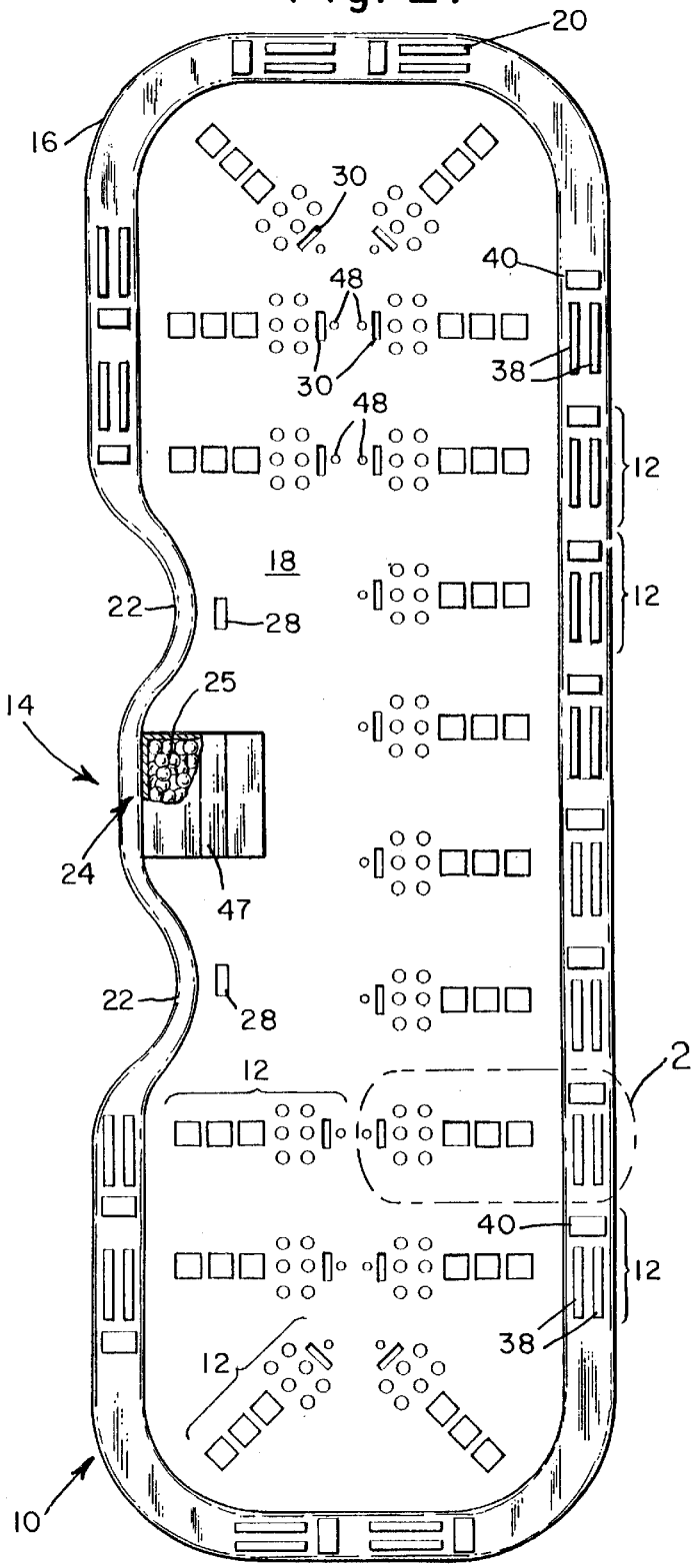
FIG. 1 is a top view of a preferred embodiment of a game table according to the present invention, for being employed in playing the game of the present invention.

Turning first to FIG. 1, there is shown a preferred embodiment of a gaming table or game table 10 in accordance with the present invention, which is of elongated generally rectangular configuration with rounded corners 16. The table may be, say, twelve to sixteen feet in length, with an approximate fourteen foot long table being a suitable example, and includes a planar top surface 18 surrounded by a raised rail 20. A plurality of playing stations or player stations 12 are spaced about the periphery of the table 10 for respectively accommodating a plurality of players around the table 10, and an operating station 14 is centrally situated along one long side of the table 10 and includes two indented operator clerk stations 22 and a random number (or other designation) generator such as a ball blower 24 mounted on the table 10. The positions of the clerk stations 22 are such as to enable two clerks, who are or represent the game operator, to have convenient access to those portions of all playing stations 12 on the table surface 18 and to operate the ball blower 24. The preferred embodiment of the table 10 includes sixteen player stations 12, and one of the two positioned operator clerks has convenient access to eight player stations 12 while the other clerk has access to the other eight player stations 12.

Figure 3:
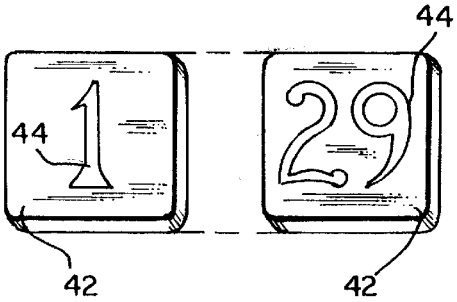
FIG. 3 is a top perspective view of numbered tiles used in a preferred manner of playing the game according to the preferred embodiment thereof.
Figure 4:
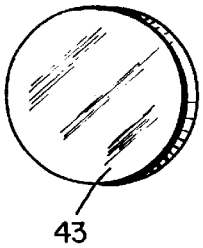
FIG. 4 is a top perspective view of a marker for use in playing the preferred game embodiment.

Considering FIGS. 2, 3, 4 and 5 along with FIG. 1, each player station 12 includes a first compartment or rack 40 for holding a first plurality of objects having respective numbers or other designations on a face thereof, preferably tiles 42 having numbers 44 thereon. The tiles 42 are preferably of a plastic material, although they may be constructed of any other suitable material such as ceramic, metal, wood or cardboard, and are preferably square in configuration. In the preferred embodiment, each player station 12 is provided with twenty-nine of such tiles 42, respectively bearing the sequential numbers 1 through 29 inclusive as represented in FIG. 3, and are initially contained or held in the rack 40. The rack 40 is preferably situated in the raised rail 20, so as to maintain the table surface 18 clear of all tiles 42 which are not in play. Also initially provided in each tile rack 40 are markers 43, preferably transparent plastic disks as shown in FIG. 4, the quantity of which is determined by the quantity of tiles 42 in use during play.

Figure 5:
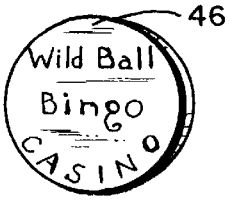
FIG. 5 is a top perspective view of an example of a gaming chip for use in playing the preferred game embodiment.

One or more racks 38, and preferable two as shown in FIG. 2, are included in each player station 12 preferably in the raised rail 20 for holding tokens or gaming chips 46 representing monetary value of one or more denominations which are typically used in gaming establishments, for example the gaming chip 46 shown in FIG. 5. Different monetary denominations are conventionally represented by different colored chips 46.

Each player station 12 includes markings or indicia 36 on the table surface 18 for permitting a player to arrange thereon a second plurality of tiles 42 selected from his or her first plurality of tiles 42. In the preferred game embodiment, three square indicia 36*a*, 36*b*, 36*c* of approximately the same dimensions as or slightly larger than the tiles 42, are aligned in a column perpendicular to the rail 20, and each player may place thereat three of the tiles 42 selected by him or her from his or her twenty-nine differently numbered tiles 42.

Each station 12 further includes markings or indicia 34 on the table surface 18, such as the three marked circles 34*a*, 34*b*, 34*c* aligned in a row generally parallel to the rail 20, for permitting a player to place thereat gaming chips representing game buy-in payments at three different levels of game play. Each player station 12 also includes a second row of indicia 32 on the table surface 18, such as the three marked circles 32*a*, 32*b*, 32*c* aligned in a row generally parallel to the rail 20, for permitting a player to place thereat gaming chips 46 representing fees to be collected by the game operator, each of which fees being associated with particular levels of play in which a player may participate, as will be explained later. It may be noted, however, that the circle indicia 32, 34 are arranged in pairs, such that circle 32*a* is clearly associated with circle 34*a*, circle 32*b* is clearly associated with circle 34*b*, and circle 32*c* is clearly associated with circle 34*c*. This may be accomplished by placing circle 32*a* directly above (i.e. as viewed in the drawing of FIG. 2) circle 34*a*, circle 32*b* directly above circle 34*b*, and circle 32*c* directly above circle 34*c*.

The ball blower 24, represented in FIG. 1, is a conventional random number generator device well known in the gaming industry and typically used for bingo, keno and other number drawing games. Examples of such ball blowers 24, also known as keno blowers, are available from Tripp Enterprises, Inc. of Sparks, Nev., such as its Auto Keno model. As implemented for use in the preferred game embodiment of the present invention, the ball blower 24 utilizes a plurality of balls 25 having designations 26 thereon similar in quantity and designations to those of the first plurality of tiles 42; i.e., in the preferred embodiment, the ball blower 24 utilizes twenty-nine balls each marked with a different one of the sequential numbers 1 through 29 inclusive (see FIG. 6). An additional or thirtieth ball 27 is included with the other twenty-nine balls 25, which additional ball 27 is not marked with a number or other designation similar to the numbers or designations on the tiles 42 and, according to the present game, is a "wild" designation able to represent any number or other designation on the twenty-nine tiles 42. In connection with the game of the present invention, the undesignated or unnumbered ball 27 is referred to as the "Wild Ball".

The preferred game embodiment is played by each player selecting three of the tiles 42 from the twenty-nine tiles 42 stored in the tile rack 40 at his or her player station 12, and placing the three selected tiles 42 on the table surface 18 at the three tile indicia or marked squares 36. The three selected tiles may be arranged along the column of marked squares 36 in numerical order, or they may be arranged in any order at the discretion of the player.

The preferred game embodiment permits players to participate in the game at up to three levels of play, and the player buys into such levels by placing buy-in payments at or on the appropriate marked circles 34. The amounts of the buy-in payments for the three levels of play are determined by the game operator; e.g., the amounts may be predetermined or preset at 25 cents, 50 cents and $1 for the first, second and third levels of play respectively; at $1, $2 and $5; at $2, $5 and $10; or at any other amounts for the respective three levels of play which the game operator determines is appropriate, and the game may be played at separate tables with respectively different buy-in amounts for the three levels of play. A fee may also be charged for each level of play, which fees are set by the game operator and are collected and retained by the game operator. For example, a fee of 25 cents may be charged for each buy-in payment of $2 or less, and a fee of 50 cents may be charged for a $5 or $10 buy-in payment.

In playing the game, each participating player is required to buy into the first level of play and does so by placing his or her buy-in payment (represented by one or more gaming chips 46 totaling the preset monetary value for buying in at the first level) on the table surface 18 at the first buy-in circle 34*a*, and at the same time he or she places the game operator fee (represented by one or more gaming chips 46 totaling the preset monetary value of the operator fee at the first level of play) on the table surface 18 at the first fee circle marking 32*a*. Only the first level of play is mandatory, while the other two levels of play are optional with each player. Although variations in the game rules may allow a player to participate in either one of the two optional levels of play independently of the other of the two optional levels, in the preferred manner of playing the game a player may not participate in the third level of play unless he or she also participates in (i.e. buys into) the second level of play.

Accordingly, when buying into the mandatory first level of play, each player at his or her option may buy into the second level of play by placing a second buy-in payment (represented by one or more gaming chips 46 totaling the preset monetary value for the second level of play) on the table surface 18 at the second buy-in circle 34*b* and also placing the game operator fee (represented by one or more gaming chips 46 totaling the preset monetary value of the operator fee at the second level of play) on the table surface 18 at the second operator fee circle 32*b*. In addition, if a player elects, he or she may buy into the optional third level of play by placing a third buy-in payment (represented by one or more gaming chips 46 totaling the preset monetary value for the third level of play) on the table surface 18 at the third buy-in circle 34*c*, and also placing an operator fee (represented by one or more gaming chips 46 totaling the preset monetary value of the operator fee at the third level of play) on the table surface 18 at the third operator fee circle 32*c*.

During the above described initial steps of the game, one of the operator clerks situated at the operator station 14 may instruct the players in the rules of the game and prompt the players to select their three tiles 42 and to place them, along with their buy-in payments and operator fees, on the table surface 18. It may be appreciated that the configuration of the table 10 and the position of the operator clerk stations 22 divides the operator responsibilities, between the two operator clerks situated at the clerk stations 22, for exchanging players' currency for gaming chips 46, for collecting the game operator fees and, at the conclusion of each level of game play, for appropriately distributing the participating players, buy-in fees to the winning players as later discussed. An opening 28 is provided at each station 22 for permitting the operator clerks to deposit the exchanged currency and the game operator fees. In slower periods, half the table 10 may be unused and only one clerk may be employed to operate the game with respect to all participating (i.e. up to eight) players.

When all players have placed their selected three tiles 42, buy-in payments and game operator fees at their appropriate indicia on the table surface 18, the operator clerk "closes" the game to further selections and buy-ins, collects the game operator fees and activates the ball blower 24. As balls are randomly selected or drawn by the ball blower 24 from the thirty balls 25, 27 and the numbers thereon called by one of the operator clerks, each player notes when a drawn number matches a number on one of his or her three selected tiles 42 and marks or "covers" such number by placing on such tile 42 one of the transparent markers 43 at his or her station. If the unnumbered ball 27 (i.e. the "Wild Ball") is drawn, each player may thereupon select and mark (or cover) any one of the previously unmatched numbers on his or her three selected tiles, in which event such number will be deemed to be matched. Although the deemed matched number tile may be marked (or covered) by placing one of the transparent markers 43 thereon, it is preferred that the deemed matched number tile be distinguished from tiles bearing numbers which have been actually drawn, for facilitating confirmation of winners. Such distinguishing from numbers actually drawn may be implemented by either placing an extra transparent marker 43 of a different color over the deemed matched number tile 42 or by simply turning the tile 42 over so that its printed number 44 is face down on the table surface 18.

The object of the game is for a player to make a "bingo", i.e. to mark or cover all three of his or her selected numbers matched by the drawn numbers including any "Wild Ball" draw. Accordingly, balls 25, 27 are drawn by the ball blower 24 until the numbers 44 on all three of the tiles 42 selected by one of the players are matched by the drawn numbers 26 or deemed matched by a "Wild Ball" draw, whereupon that one player clearly and loudly announces "bingo" and is a winner. All of the first buy-in payments on the table surface 18 are collected by such winner, i.e. all such first buy-in payments are gathered by one of the clerks and placed at the winner's station 12. If the winner had bought into the second level of play, the winner further collects all of the second buy-in payments on the table 10; and if the winner had bought into the second and third levels of play, he or she additionally collects all of the third buy-in payments on the table 10.

If, however, the winner of the first buy-in payments had not bought into the second level of play, the game is continued only with those players who had bought into the second level of play. The drawing of numbers from the ball blower 24 is resumed until the numbers 44 on the three tiles 42 selected by one of the continuing players are matched by the drawn numbers (including any "Wild Ball" draw), whereupon that one continuing player is a winner and collects all of the second buy-in payments on the table 10. If this latter-mentioned winner had also bought into the third level of play, he or she would also collect all of the third buy-in payments on the table 10.

If, however, the winner of the second buy-in payments had not bought into the third level of play, the game is continued only with the players remaining who had bought into the third level of play. The random drawing of numbers is resumed by the ball blower 24 until all numbers 44 on the three tiles 42 selected by one of the remaining players are matched by the drawn numbers (including any "Wild Ball" draw), whereupon such player is a winner and collects all of the third buy-in payments on the table 10. When all buy-in payments on the table 10 have been won, the game is ended and another game may commence.

Confirmation of the winners is made by the clerks; the drawn numbers are visible to all players at the table so that confusion or doubt as to legitimate winners is eliminated. In the event of multiple winners when a particular number is drawn, the appropriate buy-in payments on the table 10 may be equally divided among the multiple winners, or such buy-in payments may otherwise be distributed in accordance with parameters predetermined by the game operator. In any event, the game operator is at no risk for paying prizes, since the operator derives revenue solely from the collection of fees at the beginning of the game.

Since pay-outs are made in accordance with the game levels of participation designated by the players (except for the first level of play), it is clearly to every player's advantage to participate at all levels. By such participation, a player may not make the first bingo but still be in the game if the first winner has bought in only at the first level of play. This encourages the players to buy in at the optional levels for each game and, of course, to the advantage of the game operator who receives the associated operator fees. For example, in a $2–5–10 buy-in level game, winners would receive $17 from each player, or in an eight player game be returned $136 (8 times $17) for the game. These pay-outs with such few players make the game very attractive. Indeed, even a $.25–.50–1.00 game among eight players could result in payments of $14 on buy-in payments totaling $1.75. Compared with average table games, such pay-outs on such investments for each game would be quite favorable.

At a projected rate of thirty-five games per hour per table, all players at the table will have ample opportunity to win, with many individual and multiple winners making bingo each hour. The rapid-fire pace of the game would allow players to accumulate prizes quickly and move to tables at different buy-in level amounts if they decide on higher or lower buy-in level games. The table setting makes this game intimate and exciting; and although not a banking game or true casino type game, this table bingo game could rival such games in popularity.

Although three selected tiles 42 are preferred, the second plurality of selected tiles 42 need not be restricted to three. As one example, shown in FIG. 7, the tile indicia 36 may include five squares 36 arranged as a cruciform, with one column of three squares 36*a*, 36*b*, 36*c* and one row of three squares 36*d*, 36*b*, 36*e*, the column and row sharing a common central square 36*b*. In this alternative, each player would select five tiles 42 and arrange them on the table surface 18 in the column of three and the row of three forming the cruciform, in any number order. A bingo will occur when either the numbers 44 on the three selected tiles 42 arranged in the row (i.e. at square indicia 36*d*, 36*b*, 36*e*) are drawn or the numbers 44 on the three tiles 42 arranged in the column (i.e. at square indicia 36*a*, 36*b*, 36*c*) are drawn.

A progressive jackpot may be included as a feature of the present game and which may follow the same general principles as progressive jackpots in traditional bingo games. Those players who elect to be eligible for the progressive jackpot must buy into the jackpot with a jackpot buy-in payment at the time the game buy-in payments are made. For example, a player may buy into the progressive jackpot by placing a gaming chip 46 (representing the jackpot buy-in purchase amount as determined by the game operator) in an opening 30 designated for that purpose at each station 12, as shown in FIGS. 1 and 2. The current amount of the jackpot may be displayed on an electronic meter 47 above the game table 10, and the jackpot may be seeded by the game operator and increased with each player's jackpot buy-in purchase. A sensor at each opening may detect when a player buys into the jackpot and the meter advances based on a portion of the amount of the buy-in, at whatever rate the bingo operator chooses and announces. Thus a twenty-five cent buy-in may net the game operator five cents for each jackpot buy-in and advance the jackpot by twenty cents. Each advance is displayed on the electronic meter 47, and more than one table 10 may be linked for jackpot purposes so that the amount of the jackpot rapidly increases. The sensor may also cause a light 48 to illuminate at each jackpot participating player's station 12 for indicating such player's participation.

Alternatively to the slot 30/light 48 arrangement, each player station 12 may include a table marking for indicating a player's participation in the jackpot, such as the circular marking 50 at which a player may place his or her jackpot buy-in payment. In such event, the jackpot meter may be advanced by the operator clerk manually operating a switch or by other appropriate conventional device.

Winning the progressive jackpot occurs when a bingo is made by a player with the first three successively drawn balls, without the unnumbered "wild Ball", and provided of course the player had bought into the progressive jackpot. Added bonuses may be paid when a bingo is made on the first four or five numbers drawn, with fixed prizes for such bonuses. For example, a bingo on four numbers without the undesignated "Wild Ball" could pay a bonus of, say, $500 from the jackpot, which amount would be deducted from the jackpot as displayed.

An alternative jackpot feature of the present game requires the winning bingo to be made when the numbers on the first three successively drawn balls match the numbers 44 on a player's selected three tiles 42 in the order arranged, without the undesignated "Wild Ball". That is, the first number 26 drawn matches the number 44 on the selected tile 42 placed on the lowermost (as shown in the drawing of FIG. 2) square marking 36*a*, the second number 26 drawn matches the number 44 on the tile 42 placed at the mid-position marked square 36*b*, and the third number 26 drawn matches the number 44 on the tile 42 placed at the uppermost square marking 36*c*. Such an ordered jackpot bingo may be used instead of the previously described unordered jackpot bingo for winning the jackpot, or both ordered and unordered jackpot bingos may be used in the same game with the ordered jackpot bingo winning the entire jackpot amount and the unordered jackpot bingo winning a fixed prize or a fixed percentage (say, fifty percent) of the entire jackpot amount.

Thus, there has been described a preferred embodiment of a table bingo game which is characterized by its simplicity, speed of play and payoff potential. Other embodiments of the game and the game table of the present invention, as well as the manner of playing the game, may be developed without departing from the essential characteristics thereof. For example, designations in addition to or other than numbers may be utilized in playing the game. As may be readily appreciated, the game may be computerized or electronically implemented with electronic displays (e.g. liquid crystal, light emitting diodes, or video, etc.) controllable by each player at his or her player station, which may be used in place of the square indicia 36 and tiles 42, and of course computerized or electronic random number generators may replace the ball blower 24 for drawing numbers or other designations. Accordingly, the invention should be limited only to the scope of the claims listed below.

I claim:

1. A method of playing a bingo game by a plurality of players employing a table having respective player stations thereabout, comprising the steps of:

(a) providing at each of the player stations a first plurality of tiles respectively bearing different numbers;

(b) providing a random number generator for drawing numbers similar to the numbers on said first pluralities of tiles;

(c) each player selecting a second plurality of tiles from the first plurality at his or her station and placing said tiles of said second plurality on the table;

(d) each player buying into a first level of play by placing a first buy-in payment on the table, and each player at his or her option may buy into a second level of play by placing a second buy-in payment on the table;

(e) using said random number generator to draw numbers until all numbers on one of said second pluralities of tiles selected by one of the players are matched by the drawn numbers, whereupon said one player is a winner and collects all of said first buy-in payments on the table, and further collects all of said second buy-in payments on the table provided said winner had bought into said second level of play; and (f) if said winner had not bought into said second level of play, continuing the game only with the players who had bought into said second level of play by resuming the drawing of numbers until all numbers on one of said second pluralities of tiles selected by one of the continuing players are matched by the drawn numbers, whereupon said one continuing player is a winner and collects all of said second buy-in payments on the table.

2. The method of playing the game according to claim 1, wherein:

during step (a), the provided tiles of each of said first pluralities are twenty-nine in quantity and bear the numbers 1 through 29 respectively.

3. The method of playing the game according to claim 2, wherein:

during step (c), the selected tiles of each of said second pluralities are three in quantity.

4. The method of playing the game according to claim 1, wherein:

during step (d), each player who had bought into said second level of play at his or her option may buy into a third level of play by placing a third buy-in payment on the table;

during step (e), said winner further collects all of said third buy-in payments on the table provided said winner had bought into said second and third levels of play; and during step (f), said winner of said second buy-in payments further collects all of said third buy-in payments on the table provided said winner of said second buy-in payments had bought into said third level of play.

5. The method of playing the game according to claim 4, further including the step of:

(g) if said winner of said second buy-in payments had not bought into said third level of play, continuing the game only with the players remaining who had bought into said third level of play by resuming the random drawing of numbers until all numbers on one of said second pluralities of tiles selected by one of the remaining players are matched by the drawn numbers, whereupon said one remaining player is a winner and collects all of said third buy-in payments on the table.

6. The method of playing the game according to claim 4, wherein:

the game is operated by a game operator; and during step (d), each player places on the table a first fee along with his or her first buy-in payment, a second fee along with his or her second buy-in payment, and a third fee along with his or her third buy-in payment, all of said fees for collection by the game operator.

7. The method of playing the game according to claim 4, wherein:

during step (b), said provided random number generator is a ball blower including balls equal in quantity to said first plurality of tiles and respectively bearing said numbers and further including an additional unnumbered ball; and during steps (e), (f) and (g), said unnumbered ball when drawn may be deemed by each player to match one number on his or her second plurality of selected tiles.

8. The method of playing the game according to claim 1, wherein;

during step (b), said provided random number generator includes a wild designation for being drawn; and during steps (e) and (f), said wild designation when drawn may be deemed by each player to match one number on his or her second plurality of selected tiles.

9. The method of playing the game according to claim 1, wherein:

during step (d), each player at his or her option may buy into a jackpot with a jackpot buy-in payment; and during step (e), a player whose numbers on his or her selected tiles are matched by each of the first numbers successively drawn is a winner of said jackpot.

10. The method of playing the game according to claim 1, wherein:

during step (c), each player arranging his or her second plurality of tiles in a selected order;

during step (d), each player at his or her option may buy into a jackpot with a jackpot buy-in payment; and during step (e), a player whose numbers on his or her selected tiles are matched in said selected order by each of the first numbers successively drawn is a winner of said jackpot.

11. The method of playing the game according to claim 1, wherein:

the game is operated by a game operator; and during step (d), each player places on the table a fee along with his or her first buy-in payment, and another fee along with his or her second buy-in payment, all of said fees for collection by the game operator.

12. The method of playing the game according to claim 1, further including:

during step (a), providing markers at each of the player stations; and during steps (e) and (f), each player marking his or her selected numbers with said markers when matched by the drawn numbers.

13. A method of playing a game by a plurality of players, comprising the steps of:

(a) providing each player with an arrangement of designations;

(b) each player buying into a first level of play with a first buy-in payment, and each player at his or her option may buy into a second level of play with a second buy-in payment;

(c) randomly indicating ones of the designations until all designations in one of the arrangements have been indicated, whereupon the player holding said one arrangement is a winner and collects said first buy-in payments from all players, and further collects said second buy-in payments from all players who had bought into said second level of play provided said winner had bought into said second level of play; and (d) if said winner had not bought into said second level of play, continuing the game only with the players who had bought into said second level of play by resuming the random indication of designations until all designations in one of the arrangements held by the continuing players have been indicated, whereupon the continuing player holding said latter-mentioned one arrangement is a winner and collects said second buy-in payments from all of the continuing players.

14. The method of playing the game according to claim 13, wherein:

during step (b), each player at his or her option may buy into a third level of play with a third buy-in payment; and during step (c), said winner further collects said third buy-in payments from all players who had bought into said third level of play provided said winner had bought into said third level of play.

15. The method of playing the game according to claim 13, wherein:

during step (b), each player who had bought into said second level of play at his or her option may buy into a third level of play with a third buy-in payment;

during step (c), said winner further collects said third buy-in payments from all players who had bought into said third level of play provided said winner had bought into said second and third levels of play; and during step (d), said winner of said second buy-in payments further collects said third buy-in payments from all of the continuing players who had bought into said third level of play provided said winner of said second buy-in payments had bought into said third level of play.

16. The method of playing the game according to claim 15, further including the step of:

(e) if said winner of said second buy-in payments had not bought into said third level of play, continuing the game only with the players remaining who had bought into said third level of play by resuming the random selection of designations until all designations in one of the arrangements held by the remaining players have been selected, whereupon the remaining player holding said last-mentioned one arrangement is a winner and collects said third buy-in payments from all of the remaining players.

17. The method of playing the game according to claim 13, wherein:

during the random indication of designations, including a wild designation for being randomly indicated and when indicated each player may deem a one of the designations in his or her arrangement to have been indicated.

18. The method of playing the game according to claim 17, wherein:

during step (b), each player who had bought into said optional second level of play may buy into the game at an optional third level of play with an optional third buy-in payment; and during step (c), said winner further collects said optional third buy-in payments from all players who had bought into said optional third level of play provided said winner had bought into said optional second and third levels of play; and during step (d), said winner of said optional second buy-in payments further collects said optional third buy-in payments from all of the continuing players who had bought into said optional third level of play provided said winner of said optional second buy-in payments had bought into said optional third level of play.

19. The method of playing the game according to claim 18, further including the step of:

(e) if said winner of said optional second buy-in payments had not bought into said optional third level of play, continuing the game only with the players remaining who had bought into said optional third level of play by resuming the random drawing of designations until all of the designations in one of the arrangements held by the remaining players have been matched, whereupon the remaining player holding said last-mentioned one arrangement is a winner and collects said optional third buy-in payments from all of the remaining players.

20. The method of playing the game according to claim 19, wherein:

the game is operated by a game operator; and during step (b), each player provides a fee along with his or her mandatory buy-in payment, another fee along with his or her optional second buy-in payment, and a further fee along with his or her optional third buy-in payment, all of said fees for collection by the game operator.

21. The method of playing the game according to claim 19, wherein:

during the random drawing of designations, including a wild designation for being randomly drawn and which when drawn may be deemed by each player to match a one of the designations in his or her arrangement.

22. A method of playing a game by a plurality of players, comprising:

providing a game table having a surface with a plurality of player stations indicated thereon;

providing at each of said stations a first plurality of tiles respectively bearing different designations;

providing a random designation generator for drawing designations similar to the designations on said first pluralities of tiles;

each player selecting a second plurality of tiles from said tiles of said first plurality at his or her station and arranging said tiles of said second plurality in at least one arrangement of a predetermined quantity of tiles on said table;

each player buying into the game by placing a buy-in payment of a predetermined amount on said table; and using said random designation generator to draw designations until all designations on one arrangement of tiles selected by one of the players are matched by the drawn designations, whereupon said one player is a winner and collects all of said buy-in payments on said table.

23. The method of playing the game according to claim 22, wherein:

said predetermined quantity of designations is three.

24. The method of playing the game according to claim 22, wherein:

the designations for being drawn by said random designation generator further include a wild designation which when drawn may thereupon be deemed by each player to match one of his or her selected designations.

25. The method of playing the game according to claim 22, wherein when buying into the game, each player may further buy into an optional level of play by placing an optional buy-in payment on the table; and said winner further collects all of said optional buy-in payments on the table provided said winner had bought into said optional level of play; and further if said winner had not bought into said optional level of play, continuing the game only with the players who had bought into said optional level of play by resuming the random drawing of designations until all designations in one arrangement of designations selected by one of the continuing players are matched, whereupon said one continuing player is a winner and collects all of said optional buy-in payments on said table.

26. A method of playing of playing a bingo game by a plurality of players employing a table having respective player stations thereabout, comprising the steps of:

(a) each player selecting a plurality of designations from another plurality of designations and arranging his or her selected designations on the table at his or her station;

(b) each player buying into the game with a mandatory buy-in payment of a predetermined amount, and each player may buy into the game at an optional second level of play with an optional second buy-in payment;

(c) randomly drawing designations similar to the designations of said other plurality until all designations in one of the arrangements have been matched, whereupon the player holding said one arrangement is a winner and collects said mandatory buy-in payments from all of the other players, and said winner further collects said optional second buy-in payments from all players who bought into said optional second level of play provided said winner had bought into said optional second level of play; and (d) if said winner had not bought into said optional second level of play, continuing the game only with the players who had bought into said optional second level of play, by resuming the random drawing of designations until all designations in one of the arrangements held by the continuing players have been matched, whereupon the continuing player holding said latter-mentioned one arrangement is a winner and collects said optional second buy-in payments from all of the continuing players.

27. The method of playing the game according to claim 26, wherein:

during the random drawing of designations, including a wild designation for being randomly drawn and which when drawn may be deemed by each player to match a one of the designations in his or her arrangement.

28. A method of playing a bingo game by a plurality of players, comprising:

providing a game table having a surface with a plurality of player stations indicated thereon;

providing at each of said stations a first plurality of designations;

providing a random designation generator for drawing designations similar to the designations of said first pluralities at said stations;

each player selecting a second plurality of designations from said first plurality at his or her station and arranging said designations of said second plurality in at least one arrangement of a predetermined quantity of designations on said table;

each player buying into the game by placing a buy-in payment of a predetermined amount on said table, and each player may buy into an optional level of play by placing an optional buy-in payment on said table;

using said random designation generator to draw designations until all designations in one arrangement of designations selected by one of the players are matched by the drawn designations, whereupon said one player is a winner and collects all of said buy-in payments on said table, and said winner further collects all of said optional buy-in payments on the table provided said winner had bought into said optional level of play; and if said winner had not bought into said optional level of play, continuing the game only with the players who had bought into said optional level of play by resuming the random drawing of designations until all designations in one arrangement of designations selected by one of the continuing players are matched, whereupon said one continuing player is a winner and collects all of said optional buy-in payments on said table.

29. A method of playing a game by a plurality of players, comprising the steps of:

(a) providing a game table having a surface with a plurality of player stations indicated thereon;

(b) providing at each of said stations a first plurality of tiles respectively bearing different designations;

(c) providing a random designation generator for drawing designations similar to the designations on said first pluralities of tiles;

(d) each player selecting a second plurality of tiles from said tiles of said first plurality at his or her station and arranging said tiles of said second plurality on said table;

(e) each player buying into the game with a mandatory buy-in payment of a predetermined amount; and (f) using said random designation generator to draw designations until all designations on one of said second pluralities of tiles selected by one of the players are matched by the drawn designations, whereupon said one player is a winner and collects all of said mandatory buy-in payments on said table.

30. The method of playing the game according to claim 29, wherein:

during step (c), said provided random designation generator is a ball blower including balls equal in quantity to said first plurality of tiles and respectively bearing said designations and further including an additional wild designation ball; and during step (f), said wild designation ball when drawn may thereupon be deemed by each player to match one designation on his or her second plurality of selected tiles.

31. The method of playing the game according to claim 29, wherein:

during step (e), each player at his or her option may buy into a jackpot with a jackpot buy-in payment; and during step (f), a player whose designations on his or her selected tiles are matched in the order arranged by each of the first designations successively drawn is a winner of said jackpot.

32. The method of playing the game according to claim 29, wherein:

said designations are numbers; and said random designation generator is a random number generator.

* * * * *

UNITED STATES PATENT AND TRADEMARK OFFICE

CERTIFICATE OF CORRECTION

PATENT NO. : 5,823,534

DATED : October 20, 1998

INVENTOR(S) : Frank B. Banyai

It is certified that error appears in the above-identified patent and that said Letters Patent is hereby corrected as shown below:

At column 2, line 6, "Ser. No. 08/588,828" should be --Ser. No. 08/558,828--

At column 13, line 29 and continuing to line 30, "claim 17" should be --claim 26--

Signed and Sealed this

Sixteenth Day of February, 1999

*Attest:*

*Attesting Officer*

*Acting Commissioner of Patents and Trademarks*